US007744726B2

(12) United States Patent
Scherb et al.

(10) Patent No.: US 7,744,726 B2
(45) Date of Patent: Jun. 29, 2010

(54) TWIN WIRE FOR AN ATMOS SYSTEM

(75) Inventors: Thomas T. Scherb, Sao Paulo (BR); Luiz Carlos Da Silva, Campo Limpo (BR); Rogerio Berardi, Sao Paulo (BR); Danilo Oyakawa, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 550 days.

(21) Appl. No.: 11/735,211

(22) Filed: Apr. 13, 2007

(65) Prior Publication Data

US 2007/0240842 A1 Oct. 18, 2007

Related U.S. Application Data

(60) Provisional application No. 60/791,885, filed on Apr. 14, 2006.

(51) Int. Cl.
*D21F 1/76* (2006.01)
*D21F 1/78* (2006.01)
*D21F 1/80* (2006.01)

(52) U.S. Cl. ..... 162/205; 162/210; 162/290; 162/301; 162/305; 162/306; 162/308; 162/358.1; 162/362; 162/364

(58) Field of Classification Search ..... 162/358.1, 162/358.3, 358.4, 900–903, 204–207, 363, 162/364, 367, 368, 348, 358.5, 359.1, 203, 162/208, 210, 300, 301, 305, 308, 290, 306, 162/362; 100/37, 121, 118, 151, 153
See application file for complete search history.

(56) References Cited

U.S. PATENT DOCUMENTS 3,293,121 A 12/1966 Martin
3,301,746 A 1/1967 Sanford et al.
3,399,111 A 8/1968 Beaumont et al.
3,655,507 A 4/1972 Nykopp
3,797,384 A 3/1974 Hoff
3,798,121 A 3/1974 Busker et al.
3,974,026 A 8/1976 Emson et al.
3,994,771 A 11/1976 Morgan, Jr. et al.
4,102,737 A 7/1978 Morton
4,162,190 A 7/1979 Ashworth
4,191,609 A 3/1980 Trokhan (Continued)

FOREIGN PATENT DOCUMENTS

DE 37 28 124 3/1989

(Continued)

OTHER PUBLICATIONS

U.S. Appl. No. 11/276,789, filed Mar. 14, 2005 is discussed on paragraphs [0016] and [0047] of the instant application.

(Continued)

*Primary Examiner*—Eric Hug
(74) *Attorney, Agent, or Firm*—Greenblum & Bernstein, P.L.C.

(57) ABSTRACT

Dewatering system for dewatering a web. The system comprises a former, a belt press, and a structured fabric comprising a paper web facing side and being guided over a support surface and through the belt press. The structured fabric runs at a speed differential relative to a wire of the former. This Abstract is not intended to define the invention disclosed in the specification, nor intended to limit the scope of the invention in any way.

40 Claims, 1 Drawing Sheet

U.S. PATENT DOCUMENTS

| | | | | |
|---|---|---|---|---|
| 4,239,065 | A | 12/1980 | Trokhan | |
| 4,427,734 | A | 1/1984 | Johnson | |
| 4,431,045 | A | 2/1984 | Josefsson | |
| 4,440,597 | A * | 4/1984 | Wells et al. | 162/111 |
| 4,464,226 | A | 8/1984 | Karvinen | |
| 4,496,429 | A | 1/1985 | Salminen et al. | |
| 4,564,551 | A | 1/1986 | Best | |
| 4,888,096 | A | 12/1989 | Cowan et al. | |
| 4,948,467 | A | 8/1990 | Creagan | |
| 5,053,109 | A | 10/1991 | Penven | |
| 5,200,260 | A | 4/1993 | Hsu | |
| 5,437,107 | A | 8/1995 | Ensign et al. | |
| 5,507,915 | A | 4/1996 | Durkin et al. | |
| 5,510,001 | A | 4/1996 | Hermans et al. | |
| 5,510,002 | A | 4/1996 | Hermans et al. | |
| 5,598,643 | A | 2/1997 | Chuang et al. | |
| 5,699,626 | A | 12/1997 | Chuang et al. | |
| 5,701,682 | A | 12/1997 | Chuang et al. | |
| 5,819,811 | A | 10/1998 | Baker et al. | |
| 5,830,316 | A | 11/1998 | Ampulski | |
| 5,853,547 | A | 12/1998 | Ahrens et al. | |
| 5,865,955 | A | 2/1999 | Ilvespaa et al. | |
| 6,051,105 | A | 4/2000 | Ampulski | |
| 6,094,834 | A | 8/2000 | Taipale et al. | |
| 6,096,169 | A | 8/2000 | Herman et al. | |
| 6,140,260 | A | 10/2000 | Johnson et al. | |
| 6,149,767 | A | 11/2000 | Hermans et al. | |
| 6,187,137 | B1 | 2/2001 | Druecke et al. | |
| 6,228,220 | B1 | 5/2001 | Hada et al. | |
| 6,237,644 | B1 | 5/2001 | Hay et al. | |
| 6,331,230 | B1 | 12/2001 | Hermans et al. | |
| 6,436,240 | B1 | 8/2002 | Jeffrey | |
| 6,454,904 | B1 | 9/2002 | Herman et al. | |
| 6,488,816 | B1 | 12/2002 | Klerelid | |
| 6,497,789 | B1 | 12/2002 | Hermans et al. | |
| 6,514,382 | B1 | 2/2003 | Kakiuchi et al. | |
| 6,616,812 | B2 | 9/2003 | Beck | |
| 6,766,817 | B2 | 7/2004 | da Silva | |
| 6,780,282 | B2 | 8/2004 | Scherb et al. | |
| 6,855,229 | B2 | 2/2005 | McKay et al. | |
| 6,918,404 | B2 | 7/2005 | da Silva | |
| 7,066,586 | B2 | 6/2006 | da Silva | |
| 7,207,356 | B2 | 4/2007 | Patel et al. | |
| 7,285,255 | B2 | 10/2007 | Kadlec et al. | |
| 7,294,237 | B2 | 11/2007 | Herman et al. | |
| 7,476,293 | B2 * | 1/2009 | Herman et al. | 162/206 |
| 7,510,631 | B2 * | 3/2009 | Scherb et al. | 162/358.1 |
| 2002/0060046 | A1 | 5/2002 | Scherb et al. | |
| 2003/0033727 | A1 | 2/2003 | Stlljes, Jr. et al. | |
| 2003/0051848 | A1 | 3/2003 | Watanabe | |
| 2003/0056295 | A1 | 3/2003 | Ragnar et al. | |
| 2003/0056911 | A1 | 3/2003 | Hermans et al. | |
| 2003/0056925 | A1 | 3/2003 | Beck | |
| 2003/0070781 | A1 | 4/2003 | Hermans et al. | |
| 2003/0136018 | A1 | 7/2003 | Herman et al. | |
| 2004/0152574 | A1 | 8/2004 | Beck et al. | |
| 2004/0173333 | A1 | 9/2004 | Hermans et al. | |
| 2004/0180596 | A1 | 9/2004 | Beck | |
| 2004/0237210 | A1 | 12/2004 | Thoroe-Scherb et al. | |
| 2005/0126031 | A1 | 6/2005 | Herman et al. | |
| 2005/0167061 | A1 * | 8/2005 | Scherb et al. | 162/115 |
| 2005/0167062 | A1 | 8/2005 | Herman et al. | |
| 2005/0167066 | A1 * | 8/2005 | Herman et al. | 162/203 |
| 2005/0167067 | A1 | 8/2005 | Crook et al. | |
| 2005/0167068 | A1 | 8/2005 | Herman et al. | |
| 2006/0085998 | A1 | 4/2006 | Herman et al. | |
| 2006/0085999 | A1 | 4/2006 | Scherb et al. | |
| 2006/0086473 | A1 | 4/2006 | Herman et al. | |
| 2007/0068645 | A1 | 3/2007 | Silva | |
| 2007/0215304 | A1 | 9/2007 | Fernandes et al. | |
| 2007/0251659 | A1 | 11/2007 | Fernandes et al. | |
| 2007/0251660 | A1 | 11/2007 | Walkenhaus et al. | |

FOREIGN PATENT DOCUMENTS

| | | |
|---|---|---|
| DE | 196 27 891 | 1/1998 |
| DE | 198 45 954 | 4/2000 |
| DE | 199 46 979 | 4/2001 |
| DE | 101 29 613 | 1/2003 |
| EP | 0 878 579 | 11/1998 |
| EP | 1 293 602 | 3/2003 |
| EP | 1 518 960 | 3/2005 |
| EP | 0 658 649 | 6/2005 |
| GB | 2141749 | 1/1985 |
| WO | 03/054292 | 7/2003 |
| WO | 03/062528 | 7/2003 |
| WO | 2004/038093 | 5/2004 |
| WO | 2005/075732 | 8/2005 |
| WO | 2005/075736 | 8/2005 |
| WO | 2005/075737 | 8/2005 |

OTHER PUBLICATIONS

U.S. Appl. No. 11/380,835, filed Apr. 28, 2006 is discussed on paragraphs [0017] and [0049] of the instant application.
U.S. Appl. No. 11/380,826, filed Apr. 28, 2006 is discussed on paragraphs [0018] and [0061] of the instant application.
U.S. Appl. No. 11/189,884, filed Jul. 27, 2005 is discussed on paragraph [0043] of the instant application.

* cited by examiner

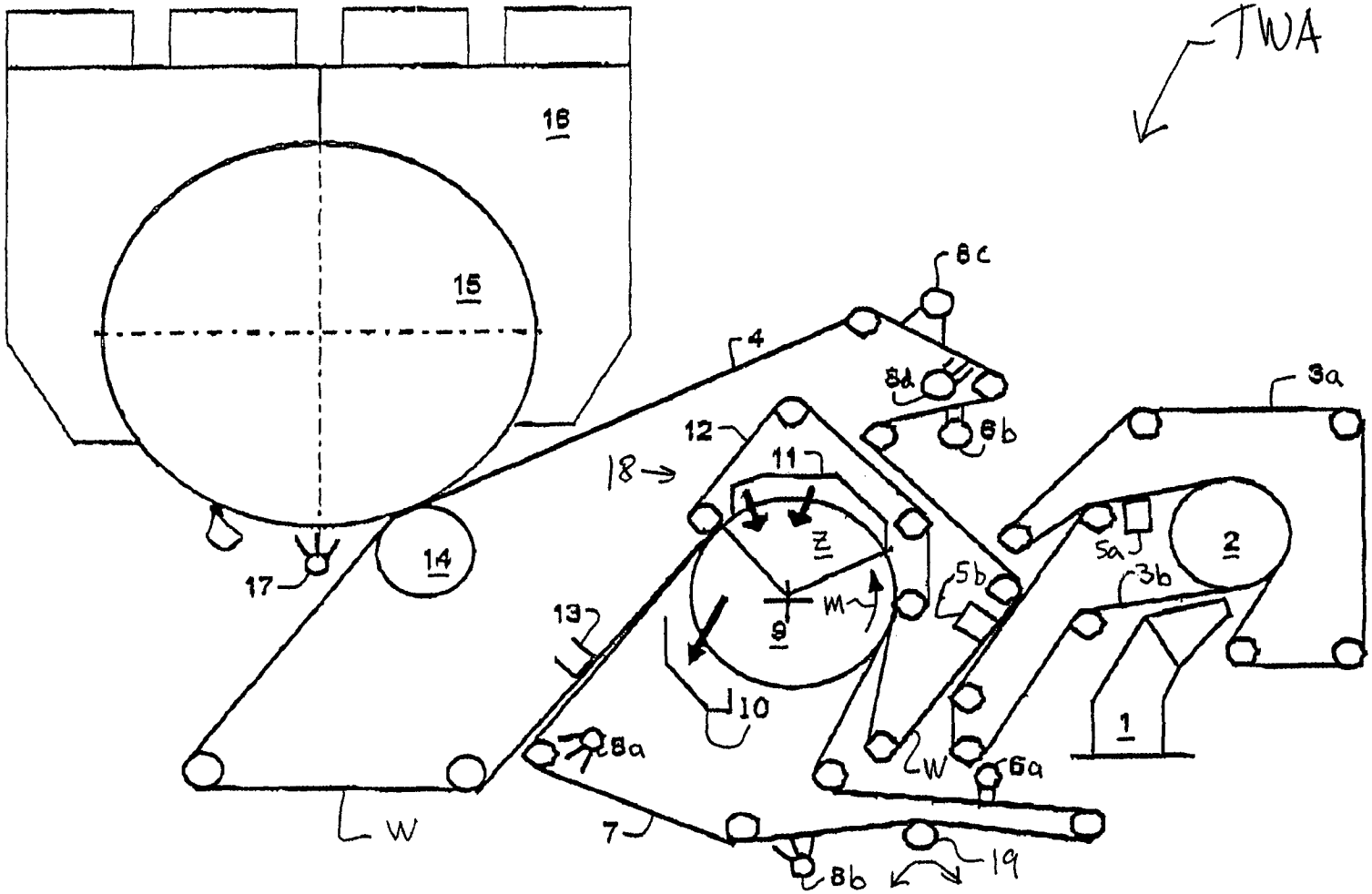
TWA
3a
2
1
3b
5a
5b
6a
19
8b
8c
8a
6b
W
M
N
9
11
10
12
4
18
13
7
16
15
14
17

TWIN WIRE FOR AN ATMOS SYSTEM

CROSS-REFERENCE TO RELATED APPLICATIONS

The present application claims priority under 35 U.S.C. §119(e) of U.S. provisional Application No. 60/791,885 filed Apr. 14, 2006, the disclosure of which is expressly incorporated by reference herein in its entirety.

BACKGROUND OF THE INVENTION

1. Field of the Invention

The present invention relates to a paper machine, and, more particularly, to a former for manufacturing premium tissue and toweling, and also relates to a former which utilizes a belt press in a paper machine. The present invention relates to a twin wire former for manufacturing premium issue and toweling which utilizes a belt press in a paper machine. The system of the invention is capable of producing premium tissue or toweling with a quality similar to a through-air drying (TAD) but with up to a 40% cost savings.

The present invention also relates to a twin wire former ATMOS system which utilizes a structured fabric which has good resistance to pressure and excessive tensile strain forces, and which can withstand wear/hydrolysis effects that are experienced in an ATMOS system. The system also includes a permeable belt for use in a high tension extended nip around a rotating roll or a stationary shoe and/or which is used in a papermaking device/process, and a dewatering fabric for the manufacture of premium tissue or towel grades without utilizing a through-air drying (TAD) system. The fabric has key parameters which include permeability, weight, caliper, and certain compressibility.

2. Description of the Related Art

In an ATMOS system, a sheet is formed on a structured or molding fabric and the sheet is further sandwiched between the structured or molding fabric and a dewatering fabric. The sheet is dewatered through the dewatering fabric and opposite the molding fabric. The dewatering takes place with air flow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet dried by a Yankee/Hood dryer arrangement and then dry creped. In the ATMOS system, one and the same structured fabric is used to carry the sheet from the headbox to the Yankee dryer.

International Publication No. WO2005/075736, the disclosure of which is hereby expressly incorporated by reference in its entirety, discloses an ATMOS system which uses a belt press and which can utilize a twin wire configuration. However, this document does not address the advantages of utilizing differential speeds between a forming belt and a structured fabric according to the invention.

U.S. Pat. No. 4,440,597 to WELLS et al., the disclosure of which is hereby expressly incorporated by reference in its entirety, and, in particular, the Abstract of this document, discloses a process that utilizes a differential velocity transfer of a wet-laid embryonic web having relatively low fiber consistency from a carrier to a substantially slower moving, open-mesh transfer fabric having a substantial void volume. The web is then dried while precluding substantial macroscopic rearrangement of the fibers in the plane of the web. The differential velocity transfer is effected without substantial compaction of the web by avoiding substantial mechanical pressing, centrifugal slinging, air blasting, and the like.

International Publication No. WO 2005/075732, the disclosure of which is hereby expressly incorporated by reference in its entirety, discloses a belt press utilizing a permeable belt in a paper machine which manufactures tissue or toweling. According to this document, the web is dried in a more efficient manner than has been the case in prior art machines such as TAD machines. The formed web is passed through similarly open fabrics and hot air is blown from one side of the sheet through the web to the other side of the sheet. A dewatering fabric is also utilized. Such an arrangement places great demands on the forming fabric because the pressure applied belt press and hot air is blown through the web in the belt press. However, this document does not address the advantages of utilizing differential speeds between a forming belt and a structured fabric according to the invention.

International Publication No. WO2005/075737, the disclosure of which is hereby expressly incorporated by reference in its entirety, discloses a structured molding fabric which can create a more three-dimensionally oriented sheet.

The disadvantages of systems of the type disclosed in International Publication No. WO2005/075736 which use a twin wire former is that the sheet is not formed on a structured fabric. Instead, the sheet is formed between inner and outer forming fabrics and then transferred via the inner forming fabric to a structured fabric without utilizing differential speeds. As a result, the voids of the structured fabric are not filled up with fibers as when the web is formed over a structured fabric. The more the voids are filled with fibers, the greater is the mass of un-pressed fibers at the Yankee and the higher the quality of the sheet.

SUMMARY OF THE INVENTION

The invention provides for a system and process which increases the amount of un-pressed fibers in the voids of a structured fabric. The invention can utilize a twin wire ATMOS system/arrangement wherein the web or sheet is first formed with a twin wire former. The web is then transferred to the structured fabric of the ATMOS system. Thus, in contrast to the standard ATMOS system, the web is not formed on the structured fabric because the structured fabric is not the inner wire of the former. Furthermore, if the inner wire of the twin wire former is a structured fabric (i.e., the first or former structured fabric), the sheet loses the knuckles when it is transferred to the other structured fabric (i.e., the second or ATMOS structured fabric) of the ATMOS. As a result, the sheet cannot achieve a target of having approximately 75% un-pressed fibers thereby negating a big advantage of the ATMOS system.

This disadvantage, however, can be minimized by forming the web in a twin wire former (without the inner wire or forming fabric being a structured fabric) and by running the ATMOS structured fabric at a lower speed than the inner forming wire. By running the inner wire and the structured fabric at different speeds (i.e., with a speed differential), the fibers of the web can dam into the ATMOS structured fabric. As a result, it is possible to fill up the pillow areas of the structured fabric with fibers.

According to one non-limiting embodiment of the invention, the speed differential can be between approximately 5% and approximately 30%. Preferably, the speed differential can be between approximately 10% and approximately 20%.

According to another non-limiting embodiment of the invention, the speed differential can be any one of the speed differential values, and/or ranges, and/or ratios disclosed in U.S. Pat. No. 4,440,597 to WELLS et al. By way of non-limiting example, the invention provides that the former can run at a speed of between approximately 1000 meters per minute (m/min) and approximately 1500 m/min while the structured fabric runs at a slower speed of between approximately 800 m/min and approximately 1200 m/min. Thus, the speed differential can be, e.g., in the range of between 50 m/min and 450 m/min, and is preferably between approximately 100 m/min and approximately 300 m/min.

However, such a configuration can be disadvantageous when there is a tensile strength loss due to the friction between the fibers on the structured fabric and the inner forming wire. For example, if the consistency between these two fabrics at the pick-up is approximately 15% to approximately 20%, it may have to be compensated for using chemicals or using more refining in order to control the tensile strength. Accordingly, a solution would involve ensuring that the consistency at the pick-up area (i.e., the transfer area from the inner forming wire to the structured fabric) is between approximately 7% and approximately 15%.

By dewatering from the belt press belt towards the web, structured fabric and the dewatering belt, contact area at the Yankee is enhanced and a higher dryer efficiency results at the Yankee. This is because the surface of the web which contacts the dewatering belt is the same surface which contacts the Yankee. Using such a configuration results in, among other things, a higher contact area between the paper web and the Yankee cylinder than is normally not achieved using a through air drying (TAD) system.

The invention also provides for a twin wire ATMOS system which utilizes the belt press belt disclosed in U.S. patent application Ser. No. 11/276,789 filed on Mar. 14, 2006. The disclosure of this US patent application is hereby expressly incorporated by reference in its entirety.

The invention additionally also provides for a twin wire ATMOS system which utilizes the dewatering fabric disclosed in U.S. patent application Ser. No. 11/380,835 filed Apr. 28, 2006. The disclosure of this US patent application is hereby expressly incorporated by reference in its entirety.

The invention further also provides for a twin wire ATMOS system which utilizes the structured fabric disclosed in U.S. patent application Ser. No. 11/380,826 filed Apr. 28, 2006. The disclosure of this US patent application is hereby expressly incorporated by reference in its entirety.

The invention also provides for a dewatering system for dewatering a web wherein the system includes a twin wire former, a belt press, and a structured fabric comprising a paper web facing side and being guided over a support surface and through the belt press. The structured fabric runs at a slower speed than a wire of the twin wire former.

The structured fabric may be a permeability value of between approximately 100 cfm and approximately 1200 cfm, a paper surface contact area of between approximately 5% and approximately 70% when not under pressure and tension, and an open area of between approximately 10% and approximately 90%.

The belt press may be arranged on an ATMOS system.

At least one surface of the structured fabric may comprise at least one of an abraded surface and a sanded surface.

The structured fabric may comprise one of a single material, a monofilament material, a multifilament material, and two or more different materials.

The structured fabric may be resistant to at least one of hydrolysis and temperatures which exceed 100 degrees C.

The support surface may be static.

The support surface may be arranged on a roll. The roll may be a vacuum roll having a diameter of between approximately 1000 mm and approximately 2500 mm. The vacuum roll may have a diameter of between approximately 1400 mm and approximately 1700 mm.

The belt press may form an extended nip with the support surface. The extended nip may have an angle of wrap of between approximately 30 degrees and approximately 180 degrees. The angle of wrap may be between approximately 50 degrees and approximately 130 degrees. The extended nip may have a nip length of between approximately 800 mm and approximately 2500 mm. The nip length may be between approximately 1200 mm and approximately 1500 mm.

The structured fabric may be an endless belt that is at least one of pre-seamed and has its ends joined on a machine which utilizes the belt press.

The structured fabric may be structured and arranged to impart a topographical pattern to a web.

The web may be at least one of a tissue web, a hygiene web, and a towel web.

The invention also provides for a method of subjecting a fibrous web to pressing in a paper machine using any of the systems described herein, wherein the method comprises forming the fibrous web in the twin wire former and applying pressure to the structured fabric and the fibrous web in the belt press.

The system may further comprise a dewatering fabric. The dewatering fabric may comprise a caliper of between approximately 0.1 mm and approximately 15 mm, a permeability value of between approximately 1 cfm and approximately 500 cfm, an overall density of between approximately 0.2 g/cm$^3$ and approximately 1.10 g/cm$^3$, and a weight of between approximately 350 g/m$^2$ and approximately 3000 g/m$^2$. The dewatering fabric may also preferably comprise a caliper of between approximately 1.0 mm and approximately 4 mm, a permeability value of between approximately 10 cfm and approximately 100 cfm, an overall density of between approximately 0.2 g/cm$^3$ and approximately 1.10 g/cm$^3$, and a weight of between approximately 900 g/m$^2$ and approximately 1400 g/m$^2$. The dewatering fabric may also most preferably comprise a caliper of between approximately 2 mm and approximately 4 mm, a permeability value of between approximately 10 cfm and approximately 50 cfm, an overall density of between approximately 0.2 g/Cm$^3$ and approximately 1.10 g/cm$^3$, and a weight of between approximately 900 g/m$^2$ and approximately 1300 g/m$^2$.

The belt press may comprise a permeable belt. The permeable belt may comprise a tension of between approximately 20 kN/m and approximately 100 KN/m, a permeability value of between approximately 100 cfm and approximately 1200 cfm, a surface contact area of the paper web side that is between approximately 0.5% and approximately 90% when not under tension, and an open area of between approximately 1.0% and approximately 85%.

A speed differential between the structured fabric and the wire may be between approximately 5% and approximately 30%. The speed differential may also be between approximately 10% and approximately 20%.

The invention also provides for a dewatering system for dewatering a web, wherein the system comprises a twin wire former comprising an outer belt and an inner belt, a belt press arranged downstream of the twin wire former, and a structured fabric arranged to support the web after the web is transferred from the inner belt. The structured fabric and the inner wire of the twin wire former run at different speeds.

A speed differential between the structured fabric and the inner wire may be between approximately 5% and approximately 30%. The speed differential may be between approximately 10% and approximately 20%.

The invention also provides for a method of subjecting a fibrous web to pressing in a paper machine using any of the systems described herein wherein the method comprises forming the fibrous web in the twin wire former and applying pressure to the structured fabric and the fibrous web in the belt press.

The invention also provides for a dewatering system for dewatering a web wherein the system includes a twin wire former comprising an outer belt, an inner belt, and a forming roll, a belt press arranged downstream of the twin wire former, a structured fabric having a web facing side and being arranged to support the web after the web is transferred from the inner belt, and a dewatering belt having a web facing side and passing through the belt press. The structured fabric runs at a slower speed than the inner wire of the twin wire former.

A speed differential between the structured fabric and the inner wire may be between approximately 5% and approximately 30%. The speed differential may be between approximately 10% and approximately 20%.

The invention also provides for a method of subjecting a fibrous web to pressing in a paper machine using any of the systems described herein, wherein the method comprises forming the fibrous web in the twin wire former and applying pressure to the structured fabric and the fibrous web in the belt press.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

The sole FIGURE is a cross-sectional schematic diagram of a machine or system which utilizes an ATMOS system having a belt press and a twin wire former.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Referring now to the FIGURE, there is shown a machine TWA for making a fibrous web W. e.g., a tissue, hygiene paper wed, etc., which can be, e.g., a twin wire ATMOS system for processing a fibrous web W. System TWA includes a headbox 1 which feeds a suspension to a twin wire former formed by an outer wire 3*a*, an inner wire 3*b* and a forming roll 2. The twin wire former can be of any conventionally known type and can preferably be of the type disclosed in e.g., U.S. patent application Ser. No. 11/189,884 filed on Jul. 27, 2005. Once the web W is formed by the twin wire former, the web W is conveyed by the inner wire 3*b* to a structured fabric 4. The web W is transferred to the structured fabric 4 from the inner wire 3*b* using a suction box 5 located at a pick-up area. The web W is conveyed by the structured fabric 4 to and through a pressing arrangement formed by a belt press assembly 18 composed of a permeable tension belt 12 and a vacuum roll 9. A dewatering fabric 7 also passes over the vacuum roll 9 and through the belt press assembly 18. The web W is dewatered in the extended belt press nip formed by the belt press assembly 18 and the vacuum roll 9 and is then carried by the structured belt 4 to a Yankee cylinder 15 and hood 16 arrangement and is transferred to the Yankee 15 using a press roll 14. A steam box and hot air blower arrangement 11 is arranged within the permeable tension belt 12 and is arranged over a suction zone Z of the vacuum roll 9. One or more savealls 10 is utilized to collect moisture collected from the vacuum roll 9. The system also utilizes a number of guide rolls for each of the belts/fabrics, an adjusting roll 19 for the dewatering belt 7, a number of Uhle boxes 6*a* and 6*b*, a number of shower units 8*a*, 8*b*, 8*c* and 8*d*, and an additional suction box or pick-up 13.

By way of non-limiting example, the outer wire 3*a* can be a conventional endless circulating wire and/or can be a DSP belt (e.g., of the type disclosed in U.S. Pat. No. 6,237,644, the disclosure of which is expressly incorporated by reference in its entirety). The outer wire 3*a* can also be any suitable conventional wire.

By way of non-limiting example, the inner wire 3*b* can be an endless circulating belt. The inner wire 3*b* can also be any suitable conventional wire.

By way of non-limiting example, the forming roll 2 can be a solid roll or an open roll. The roll 2 can also be any suitable conventional forming roll.

By way of non-limiting example, the belt press belt 12 can be a belt of the type disclosed in e.g., U.S. patent application Ser. No. 11/276,789 filed on Mar. 14, 2006, the disclosure of which is hereby expressly incorporated by reference in its entirety). By way of example, the permeable belt 12 can have a paper web facing side and can be guided over a support surface of the roll 9 and can have the following characteristics: a tension of between approximately 20 kN/m and approximately 100 KN/m, a permeability value of between approximately 100 cfm and approximately 1200 cfm, a surface contact area of the paper web side that is between approximately 0.5% and approximately 90% when not under tension, and an open area of between approximately 1.0% and approximately 85%.

For example, the permeable belt 12 can preferably have the following characteristics: the belt 12 should resist the high MD (machine direction) tension forces over a long time period without stretching and without distortion of the monofilaments; the belt12 should resist the effect of steam (and very hot water vapor) from the steam box that is in the ATMOS configuration, i.e., it should resist hydrolysis; the belt 12 should allow a sufficient volume of air through the paper sheet so that sufficient dryness (approximately 32" to approximately 35% or better) is achieved after the belt press as the web passes to the final drying at the Yankee drying and creping stage; the belt 12 should preferably have a suitable permeability and surface contact area, materials, and weave pattern as described herein; and the belt 12 should be part of a system or process that is efficient and economical way of drying tissue. The belt 12 can also be a belt press belt of the type disclosed in U.S. Ser. No. 10/972,408 filed on Oct. 26, 2004 and/or U.S. Ser. No. 10/972,431 filed on Oct. 26, 2004 and/or U.S. Ser. No. 10/768,485 filed on Jan. 30, 2004, the disclosure of these documents are hereby expressly incorporated by reference in their entireties.

By way of non-limiting example, the dewatering fabric 7 can be a dewatering fabric of the type disclosed in e.g., U.S.

patent application Ser. No. 11/380,835 filed Apr. 28, 2006, the disclosure of which is hereby expressly incorporated by reference in its entirety), and can have the following characteristics and properties. By way of example, the dewatering fabric 7 can have a paper web facing side and can be guided over a support surface such as that of the roll 9 and can have the following characteristics: a caliper of between approximately 0.1 mm and approximately 15 mm, a permeability value of between approximately 1 cfm and approximately 500 cfm, an overall density of between approximately 0.2 $g/cm^3$ and approximately 1.10 $g/cm^3$, and a weight of between approximately 350 $g/m^2$ and approximately 3000 $g/m^2$. The caliper can also preferably be between approximately 2 mm and approximately 4 mm, the permeability value can preferably be between approximately 10 cfm and approximately 50 cfm, the overall density can preferably be between approximately 0.2 $g/cm^3$ and approximately 1.10 $g/cm^3$, and the weight can preferably be between approximately 900 $g/m^2$ and approximately 1300 $g/m^2$. The dewatering fabric 7 should also preferably have good compressibility.

According to one non-limiting embodiment of the invention, the formed web W is transferred to the structured fabric 4 using the suction box 5. This occurs while the structured fabric 4 and the inner wire 3*b* are ruing at different speeds, i.e., a speed differential is utilized between the belts 3*b* and 4. Preferably, the structured belt 4 is running at a slower speed than the inner wire 3*b*. The web W moves in a machine direction M past the first suction box 5*a* and second suction box 5*b*. Using the vacuum boxes 5*a* and 5*b*, sufficient moisture can be removed from web W to achieve a solids level of between approximately 7% and approximately 25% on a typical or nominal 20 gram per square meter (gsm) web running. The vacuum at the box 5 can provide between approximately −0.2 to approximately −0.8 bar vacuum, with a preferred operating level of between approximately −0.4 to approximately −0.6 bar. As fibrous web W proceeds along the machine direction M, it comes into contact with a dewatering fabric 7. The dewatering fabric 7 can be an endless circulating belt which is guided by a plurality of guide rolls. The tension of the fabric 7 can be adjusted by adjusting guide roll 19. The dewatering belt 7 can be a dewatering fabric or felt. The web W then proceeds toward vacuum roll 9 between the structured fabric 4 and the dewatering fabric 7. The vacuum roll 9 rotates along the machine direction M and can be operated at a vacuum level of between approximately −0.2 to approximately −0.8 bar with a preferred operating level of at least approximately −0.4 bar, and most preferably approximately −0.6 bar. By way of non-limiting example, the thickness of the vacuum roll shell of roll 9 may be in the range of between approximately 25 mm and approximately 75 mm. The mean airflow through the web W in the area of the suction zone Z can be approximately 150 $m^3$/min per meter of machine width at atmospheric pressure and at ambient temperature. The structured fabric 4, web W and dewatering fabric 7 are guided through a belt press 18 formed by the vacuum roll 9 and a permeable belt 12. As is shown in the figure, the permeable belt 12 is a single endlessly circulating belt which is guided by a plurality of guide rolls and which presses against the vacuum roll 9 so as to form the belt press 18.

The upper or structured fabric 4 is an endless fabric which transports the web W to and from the belt press system 18, from the twin wire former 2/3*a*/3*b*, and to the Yankee cylinder 15 for final drying. After being transferred from the twin wire former, the web W lies in the three-dimensional structure of the upper fabric 4, and therefore it is not flat but has also a three-dimensional structure, which produces a high bulky web. The lower fabric 7 is also permeable. The design of the lower fabric 7 is made to be capable of storing water. The lower fabric 7 can also have a smooth surface. The lower fabric 7 can preferably be a felt with a batt layer. The diameter of the batt fibers of the lower fabric 7 are equal to or less than approximately 11 dtex, and can preferably be equal to or lower than approximately 4.2 dtex, or more preferably be equal to or less than approximately 3.3 dtex. The baft fibers can also be a blend of fibers. The lower fabric 7 can also contain a vector layer which contains fibers from approximately 67 dtex, and can also contain even courser fibers such as, e.g., approximately 100 dtex, approximately 140 dtex, or even higher dtex numbers. This is important for the good absorption of water. The wetted surface of the batt layer of the lower fabric 7 and/or of the lower fabric itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of the lower fabric 7 can be equal to or greater than approximately 0.04 $m^2/g$ felt weight, and can preferably be equal to or greater than approximately 0.065 $m^2/g$ felt weight, and can most preferably be equal to or greater than approximately 0.075 $m^2/g$ felt weight. This is also important for the good absorption of water. The dynamic stiffness K*[N/mm] as a value for the compressibility can be acceptable if less than or equal to 100,000 N/mm, preferable compressibility is less than or equal to 90,000 N/mm, and most preferably the compressibility is less than or equal to 70,000 N/mm. The compressibility (thickness change by force in mm/N) of the lower fabric 7 should be considered. This is important in order to dewater the web efficiently to a high dryness level. A hard surface would not press the web W between the prominent points of the structured surface of the upper fabric 4. On the other hand, the felt should not be pressed too deep into the three-dimensional structure to avoid losing bulk and therefore quality, e.g., water holding capacity.

Also by way of non-limiting example, the permeable belt 12 can be a single or multi-layer woven fabric which can withstand the high running tensions, high pressures, heat, moisture concentrations and achieve a high level of water removal required by the papermaking process. The fabric 12 should preferably have a high width stability, be able to operate at high running tensions, e.g., between approximately 20 kN/m and approximately 100 kN/m, and preferably greater than or equal to approximately 20 kN/m and less than or equal to approximately 60 kN/m. The fabric 12 should preferably also have a suitable high permeability, and can be made of hydrolysis and/or temperature resistant material. The permeable high tension belt 12 forms part of a "sandwich" structure which includes a structured belt 4 and the dewatering belt 7. These belts 4 and 7, with the web W located there between, are subjected to pressure in the pressing device 18 which includes the high tension belt 12 arranged over the rotating roll 9. In other embodiments, the belt press 18 can be used in a device which utilizes a static extended dewatering nip instead of the rotating roll 9.

Referring back to the figure, the nip formed by the belt press 18 and roll 9 can have an angle of wrap of between approximately 30 degrees and 180 degrees, and preferably between approximately 50 degrees and approximately 140 degrees. By way of non-limiting example, the nip length can be between approximately 800 mm and approximately 2500 mm, and can preferably be between approximately 1200 mm and approximately 1500 mm. Also, by way of non-limiting example, the diameter of the suction roll 418 can be between approximately 1000 mm and approximately 2500 mm or greater, and can preferably be between approximately 1400 mm and approximately 1700 mm.

To enable suitable dewatering, the single or multilayered fabric 12 should preferably have a permeability value of between approximately 100 cfm and approximately 1200 cfm, and is most preferably between approximately 300 cfm and approximately 800 cfm. The nip can also have an angle of wrap that is preferably between 50 degrees and 130 degrees. The single or multi-layered fabric or permeable belt 12 can also be an already formed (i.e., a pre-joined or seamed belt) an endless woven belt. Alternatively, the belt 12 can be a woven belt that has its ends joined together via a pin-seam or can be instead be seamed on the machine. The single or multi-layered fabric or permeable belt 12 can also preferably have a paper surface contact area of between approximately 0.5% and approximately 90% when not under pressure or tension. The contact surface of the belt should not be altered by subjecting the belt to sanding or grinding. By way of non-limiting example, the belt 12 should have an open area of between approximately 1.0% and approximately 85%. The single or multi-layered fabric or permeable belt 12 can also be a woven belt having a paper surface warp count of between approximately 5 yarns/cm and approximately 60 yarns/cm, and is preferably between approximately 8 yarns/cm and approximately 20 yarns/cm, and is most preferably between approximately 10 yarns/cm and approximately 15 yarns/cm. Furthermore, the woven belt 12 can have a paper surface weft count of between approximately 5 yarns/cm and approximately 60 yarns/cm, and is preferably between approximately 5 yarns/cm and approximately 20 yarns/cm, and is most preferably between approximately 8 yarns/cm and approximately 17 yarns/cm.

Due to the high moisture and heat which can be generated in the ATMOS papermaking process, the woven single or multi-layered fabric or permeable belt 12 can be made of one or more hydrolysis and/or heat resistant materials. The one or more hydrolysis resistant materials can preferably be a PET monofilament and can ideally have an intrinsic viscosity value normally associated with dryer and TAD fabrics, i.e., in the range of between 0.72 IV and 1.0 IV. These materials can also have a suitable "stabilization package" including carboxyl end group equivalents etc. When considering hydrolysis resistance, one should consider the carboxyl end group equivalents, as the acid groups catalyze hydrolysis, and residual DEG or di-ethylene glycol as this too can increase the rate of hydrolysis. These factors separate the resin which should be used from the typical PET bottle resin. For hydrolysis, it has been found that the carboxyl equivalent should be as low as possible to begin with and should be less than 12. For DEG level, less than 0.75% should preferably be used. Even that this low level of carboxyl end groups, it is essential that an end capping agent be added. A carbodiimide should be used during extrusion to ensure that at the end of the process there are no free carboxyl groups. There are several classes of chemical that can be used to cap the end groups, such as epoxies, ortho-esters and isocyanates, but, in practice, monomeric and combinations of monomeric with polymeric carbodiimindes are the best and most used. Preferably, all end groups are capped by an end capping agent that may be selected from the above-noted classes such that there are no free carboxyl end groups.

PPS can be used for the heat resistant materials. Other single polymer materials such as PEN, PBT, PEEK and PA can also be used to improve properties such as stability, cleanliness and life. Both single polymer yarns as well as copolymer yarns can be used.

The material used for the high tension belt 12 may not necessarily be made from monofilament, and can also be a multifilament, including the core and sheath. Other materials such as non-plastic materials can also be used, e.g., metal materials.

The permeable belt 12 need not be made of a single material and can also be made of two, three or more different materials, i.e., the belt can be a composite belt The permeable belt 12 can also be formed with an external layer, coating, and/or treatment which is applied by deposition and/or which is a polymeric material that can be cross linked during processing. Preferably, the coating enhances the fabric stability, contamination resistance, drainage, wearability, improved heat and/or hydrolysis resistance. It is also preferable if the coating reduces fabric surface tension to aide sheet release or to reduce drive loads. The treatment or coating can be applied to impart and/or improve one or more of these properties.

The permeable belt 12 does not necessarily require excellent contact area, i.e., one non-limiting example of a well performing belt 12 in an ATMOS system comprises a contact area of less than 10%. Ideally, the permeable belt 12 has a suitable permeability and surface contact area. The materials and weave of the belt are less important than such considerations.

By way of non-limiting example, the structured fabric 4 can be a structured fabric of the type disclosed in e.g., U.S. patent application Ser. No. 11/380,826 filed Apr. 28, 2006, the disclosure of which is hereby expressly incorporated by reference in its entirety). By way of example, the structured fabric 4 can have a paper web facing side and can be guided over the support surface of the roll 9 and can have the following characteristics: a permeability value of between approximately 100 cfm and approximately 1200 cfm, a paper surface contact area of between approximately 5% and approximately 70% when not under pressure and tension, and an open area of between approximately 10% and approximately 90%.

Also by way of non-limiting example, the structured fabric 4 can be a single or multi-layered woven fabric which can withstand the high pressures, heat, moisture concentrations, and which can achieve a high level of water removal and also mold or emboss the paper web required by the Voith ATMOS paper making process. The fabric 4 should also have a width stability, a suitable high permeability. The fabric 4 should also preferably utilize hydrolysis and/or temperature resistant materials.

The fabric 4 is utilized as part of a sandwich structure which includes at least two other belts and/or fabrics. These additional belts include a high tension belt 12 and a dewatering belt 7. The sandwich structure is subjected to pressure and tension over an extended nip formed by a rotating roll 9 or static support surface. The extended nip can have an angle of wrap of between approximately 30 degrees and approximately 180 degrees, and is preferably between approximately 50 degrees and approximately 130 degrees. The nip length can be between approximately 800 mm and approximately 2500 mm, and is preferably between approximately 1200 mm and approximately 1500 mm. The nip can be formed by a rotating suction roll having a diameter that is between approximately 1000 mm and approximately 2500 mm, and is preferably between approximately 1400 mm and approximately 1700 mm.

The structured fabric 4 imparts a topographical pattern into the paper sheet or web. To accomplish this, high pressures are imparted to the molding fabric 4 via a high tension belt 12. The topography of the sheet pattern can be manipulated by varying the specifications of the molding belt 4, i.e., by regulating parameters such as, yarn diameter, yarn shape, yarn density, and yarn type. Different topographical patterns can be imparted in the sheet by different surface weaves. Similarly, the intensity of the sheet pattern can be varied by altering the pressure imparted by the high tension belt 12 and by varying the specification of the molding belt 4. Other factors which can influence the nature and intensity of the typographical pattern of the sheet include air temperature, air speed, air pressure, belt dwell time in the extended nip, and nip length.

The following are non-limiting characteristics and/or properties of the structured fabric 4: to enable suitable dewatering, the single or multi-layered fabric should have a permeability value of between approximately 100 cfm and approximately 1200 cfm, and is preferably between approximately 200 cfm and approximately 900 cfm; the fabric 4 which is part of a sandwich structure with two other belts, e.g., a high tension belt 12 and a dewatering belt 7, is subjected to pressure and tension over a rotating or static support surface and at an angle of wrap of between approximately 30 degrees and approximately 180 degrees and preferably between approximately 50 degrees and approximately 130 degrees; the fabric 4 should have a paper surface contact area of between approximately 5% and approximately 70% when not under pressure or tension; the forming fabric should have an open area of between approximately 10% and approximately 90%.

The fabric 4 is preferably a woven fabric that can be installed on an ATMOS machine as a pre-joined and/or seamed continuous and/or endless belt. Alternatively, the forming fabric 4 can be joined in the ATMOS machine using e.g., a pin-seam arrangement or can otherwise be seamed on the machine. In order to resist the high moisture and heat generated by the ATMOS papermaking process, the woven single or multi-layered belt 4 may utilize either hydrolysis and/or heat resistant materials. Hydrolysis resistant materials should preferably include a PET monofilament having an intrinsic viscosity value normally associated with dryer and TAD fabrics in the range of between 0.72 IV and approximately 1.0 IV and also have a suitable "stabilization package" which including carboxyl end group equivalents, as the acid groups catalyze hydrolysis and residual DEG or di-ethylene glycol as this too can increase the rate of hydrolysis. These two factors separate the resin which can be used from the typical PET bottle resin. For hydrolysis, it has been found that the carboxyl equivalent should be as low as possible to begin with, and should be less than approximately 12. The DEG level should be less than approximately 0.75%. Even at this low level of carboxyl end groups it is essential that an end capping agent be added, and should utilize a carbodiimide during extrusion to ensure that at the end of the process there are no free carboxyl groups. There are several classes of chemical than can be used to cap the end groups such as epoxies, ortho-esters, and isocyanates, but in practice monomeric and combinations of monomeric with polymeric carbodiimindes are the best and most used.

Heat resistant materials such as PPS can be utilized in the structured fabric 4. Other materials such as PEN, PBT, PEEK and PA can also be used to improve properties of the fabric 4 such as stability, cleanliness and life. Both single polymer yarns and copolymer yarns can be used. The material for the belt 4 need not necessarily be made from monofilament and can be a multi-filament, core and sheath, and could also be a non-plastic material, i.e., a metallic material. Similarly, the fabric 4 may not necessarily be made of a single material and can be made of two, three or more different materials. The use of shaped yarns, i.e., non-circular yarns, can also be utilized to enhance or control the topography or properties of the paper sheet. Shaped yarns can also be utilized to improve or control fabric characteristics or properties such as stability, caliper, surface contact area, surface planarity, permeability and wearability.

The structured fabric 4 can also be treated and/or coated with an additional polymeric material that is applied by e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduce drive loads. The treatment/coating can be applied to impart/improve one or several of these properties of the fabric 4. As indicated previously, the topographical pattern in the paper web W can be changed and manipulated by use of different single and multi-layer weaves. Further enhancement of the pattern can be further attained by adjustments to the specific fabric weave by changes to the yarn diameter, yarn counts, yarn types, yarn shapes, permeability, caliper and the addition of a treatment or coating etc. Finally, one or more surfaces of the fabric or molding belt 4 can be subjected to sanding and/or abrading in order to enhance surface characteristics.

It is noted that the foregoing examples have been provided merely for the purpose of explanation and are in no way to be construed as limiting of the present invention. While the present invention has been described with reference to exemplary embodiments, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

What is claimed:

1. A dewatering system for dewatering a web, the system comprising:

a former comprising an inner forming wire;

a belt press; and a structured fabric comprising a paper web facing side and being guided over a support surface and through the belt press, wherein the structured fabric runs at a slower speed than the former, and wherein the inner forming wire is not a structured fabric.

2. The system of claim 1, wherein the structured fabric comprising a permeability value of between approximately 100 cfm and approximately 1200 cfm, a paper surface contact area of between approximately 5% and approximately 70% when not under pressure and tension, and an open area of between approximately 10% and approximately 90%.

3. The system of claim 1, wherein the belt press is arranged on an ATMOS system.

4. The system of claim 1, wherein at least one surface of the structured fabric comprises at least one of an abraded surface and a sanded surface.

5. The system of claim 1, wherein the structured fabric comprises one of:

a single material;

a monofilament material;

a multifilament material; and two or more different materials.

6. The system of claim 1, wherein the structured fabric is resistant to at least one of hydrolysis and temperatures which exceed 100 degrees C.

7. The system of claim 1, wherein the support surface is static.

8. The system of claim 1, wherein the support surface is arranged on a roll.

9. The system of claim 8, wherein the roll is a vacuum roll having a diameter of between approximately 1000 mm and approximately 2500 mm.

10. The system of claim 9, wherein the vacuum roll has a diameter of between approximately 1400 mm and approximately 1700 mm.

11. The system of claim 1, wherein the belt press forms an extended nip with the support surface.

12. The system of claim 11, wherein the extended nip has an angle of wrap of between approximately 30 degrees and approximately 180 degrees.

13. The system of claim 12, wherein the angle of wrap is between approximately 50 degrees and approximately 130 degrees.

14. The system of claim 11, wherein the extended nip has a nip length of between approximately 800 mm and approximately 2500 mm.

15. The system of claim 14, wherein the nip length is between approximately 1200 mm and approximately 1500 mm.

16. The system of claim 1, wherein the structured fabric is an endless belt that is at least one of pre-seamed and has its ends joined on a machine which utilizes the belt press.

17. The system of claim 1, wherein the structured fabric is structured and arranged to impart a topographical pattern to a web.

18. The system of claim 1, wherein the web comprises at least one of a tissue web, a hygiene web, and a towel web.

19. A method of subjecting a fibrous web to pressing in a paper machine using the system of claim 1, the method comprising:

forming the fibrous web in the former; and applying pressure to the structured fabric and the fibrous web in the belt press.

20. The system of claim 1, further comprising a dewatering fabric.

21. The system of claim 20, wherein the dewatering fabric comprises a caliper of between approximately 0.1 mm and approximately 15 mm, a permeability value of between approximately 1 cfm and approximately 500 cfm, an overall density of between approximately 0.2 g/cm$^3$ and approximately 1.10 g/cm$^3$, and a weight of between approximately 350 g/m$^2$ and approximately 3000 g/m$^2$.

22. The system of claim 1, wherein the belt press comprises a permeable belt.

23. The system of claim 22, wherein the permeable belt comprises a tension of between approximately 20 kN/m and approximately 100 KN/m, a permeability value of between approximately 100 cfm and approximately 1200 cfm, a surface contact area of the paper web side that is between approximately 0.5% and approximately 90% when not under tension, and an open area of between approximately 1.0% and approximately 85%.

24. The system of claim 1, wherein a speed differential between the structured fabric and the inner forming wire of the former is between approximately 5% and approximately 30%.

25. The system of claim 24, wherein the speed differential is between approximately 10% and approximately 20%.

26. The system of claim 1, wherein the former is at least one of:

a twin wire former;

a Fourdrinier machine;

a machine which forms the web and transfers the web to the structured fabric; and a machine which transfers the web to the structured fabric utilizing a pick-up device.

27. The system of claim 1, wherein the former further comprises an outer forming wire and a forming roll and wherein the inner forming wire transfers the paper web to the structured fabric.

28. The system of claim 1, wherein the inner forming wire transfers the paper web to the structured fabric.

29. The system of claim 1, wherein the paper web has approximately 75% un-pressed fibers.

30. A dewatering system for dewatering a web, the system comprising:

a twin wire former comprising an outer wire and an inner wire;

a belt press arranged downstream of the twin wire former; and a structured fabric arranged to support the web after the web is transferred from the inner wire, wherein the structured fabric and the inner wire of the twin wire former run at different speeds, and wherein the inner wire is not a structured fabric.

31. The system of claim 30, wherein a speed differential between the structured fabric and the inner wire is between approximately 5% and approximately 30%.

32. The system of claim 31, wherein the speed differential is between approximately 10% and approximately 20%.

33. A method of subjecting a fibrous web to pressing in a paper machine using the system of claim 30, the method comprising:

forming the fibrous web in the twin wire former; and applying pressure to the structured fabric and the fibrous web in the belt press.

34. The system of claim 30, wherein the paper web has approximately 75% un-pressed fibers.

35. A dewatering system for dewatering a web, the system comprising:

a twin wire former comprising an outer wire, an inner wire, and a forming roll;

a belt press arranged downstream of the twin wire former;

a structured fabric having a web facing side and being arranged to support the web after the web is transferred from the inner wire; and a dewatering belt having a web facing side and passing through the belt press, wherein the structured fabric runs at a slower speed than the inner wire of the twin wire former, and wherein the inner wire is not a structured fabric.

36. The system of claim 35, wherein a speed differential between the structured fabric and the inner wire is between approximately 5% and approximately 30%.

37. The system of claim 36 wherein the speed differential is between approximately 10% and approximately 20%.

38. The system of claim 35, wherein the web is subjected to drying in the belt press by utilizing air flow through the structured fabric, then through the web, and then through the dewatering belt.

39. A method of subjecting a fibrous web to pressing in a paper machine using the system of claim 35, the method comprising:

forming the fibrous web in the twin wire former; and applying pressure to the structured fabric and the fibrous web in the belt press.

40. The system of claim 35, wherein the paper web has approximately 75% un-pressed fibers.

* * * * *